United States Patent [19]

Yoneda et al.

[11] 4,446,834

[45] May 8, 1984

[54] SYSTEM FOR FEEDBACK CONTROL OF AIR-FUEL RATIO IN INTERNAL COMBUSTION ENGINE

[75] Inventors: Kenji Yoneda, Atsugi; Shoji Arai, Yokohama; Yoshimi Kunome, Yokosuka, all of Japan

[73] Assignee: Nissan Motor Co., Ltd., Kanagawa, Japan

[21] Appl. No.: 319,997

[22] Filed: Nov. 10, 1981

[30] Foreign Application Priority Data

Nov. 12, 1980 [JP] Japan ..... 55-159114

[51] Int. Cl.[3] ..... F02M 37/00; F02B 73/10; F02M 25/06; F01N 3/00

[52] U.S. Cl. ..... 123/440; 123/587

[58] Field of Search ..... 123/440, 585, 587, 589; 60/276, 285; 261/DIG. 56, 44 D; 137/DIG. 8

[56] References Cited

U.S. PATENT DOCUMENTS 3,330,544 7/1967 Ozersky ..... 123/587
3,796,049 3/1974 Hayashi ..... 123/587
4,103,654 8/1978 Nakamura ..... 123/587

*Primary Examiner*—Raymond A. Nelli
*Attorney, Agent, or Firm*—Lowe, King, Price & Becker

[57] ABSTRACT

A system for feedback control of the air-fuel ratio in a carburetor for an automotive internal combustion engine. The control system includes an auxiliary air bleed passage in the main air bleed of a fuel passage, an electromagnetic valve to periodically open and close the auxiliary air bleed passage, an exhaust sensor to detect a specific component of the exhaust gas as an indication of actual air-fuel ratio, and a control circuit to control the electromagnetic valve based on the output of the exhaust sensor. A vacuum passage connects the auxiliary air bleed passage at a section upstream of the electromagnetic valve to a venturi of the intake passage. A vacuum-responsive valve in the vacuum passage dilutes air admitted through the auxiliary air bleed passage with the venturi vacuum during higher speed operation of the engine to compensate for a tendency of the air through the auxiliary air bleed passage to be augmented.

7 Claims, 7 Drawing Figures

SYSTEM FOR FEEDBACK CONTROL OF AIR-FUEL RATIO IN INTERNAL COMBUSTION ENGINE

BACKGROUND OF THE INVENTION

1. Field of the Invention

The present invention relates to a system for feedback control of the air-fuel ratio of an air-fuel mixture prepared in a carburetor of an internal combustion engine based on the concentration of a specific component of the exhaust gas.

2. Description of the Prior Art

In modern internal combustion engines in automobiles, it is generally necessary to controls the air-fuel ratio of an air-fuel mixture for the engine at a predetermined value with high accuracy in order to purify the exhaust gas and reduce the specific fuel consumption. Such control is necessary for instance, with engines equipped with a catalytic converter containing a so-called three-way catalyst which can catalyze both the oxidation of hydrocarbons (HC) and carbon monoxide (CO) and reduce nitrogen oxides ($NO_x$). The converter converts these three major noxious components of the exhaust gas into harmless substances. In such engines, it is necessary to maintain the air-fuel ratio within a very narrow range wherein there is a stoichiometric air-fuel ratio (14.7 by weight for air-gasoline mixture) because the three-way catalyst in the converter performs best when the engine is operating with a stoichiometric or nearly stoichiometric air-fuel mixture.

For controlling the air-fuel ratio, a closed loop (feedback) control system is usually used because it is difficult to attain sufficiently high accuracy of control by open loop control. A typical feedback control system for this purpose employs an exhaust sensor which detects the concentration of a specific component (for example, oxygen) of the exhaust gas, which concentration is closely related to the air-fuel ratio of an air-fuel mixture burned in the engine. The detected concentration controls the air-fuel ratio to a predetermined value, such as the stoichiometric ratio, by controlling the rate of fuel feed to the engine based on a feedback signal produced by the exhaust sensor. When the engine is equipped with a carburetor, an advantageous method of controlling the fuel feed rate is to connect an auxiliary air bleed passage to a conventional air bleed for a fuel passage in the carburetor and control the quantity of air admitted into the fuel passage through the auxiliary air bleed passage by means of the electromagnetic valve of an on-off type. An electronic control circuit supplies a constant frequency control pulse signal to periodically open and close the electromagnetic valve. The control circuit varies the duty ratio of the pulse signal based on the output signal of the exhaust sensor such that the proportion of the open-time of the electromagnetic valve to the closed-time increases when the measured air-fuel ratio indicated by the output of the exhaust sensor is lower than the desired ratio, and vice versa, whereby the air-fuel ratio converges to the desired ratio.

In practical operation of this feedback control system, however, there is an undesirable tendency that air admitted through the auxiliary air bleed passage augments significantly the air-fuel ratio when the engine is at a high speed and high load operating condition. At this condition, the flow rate of air in a venturi section of the intake passage increases. That is, the maximal value of the air-fuel ratio under the feedback control begins to gradually increase as the engine speed exceeds a certain level. This increases the width of a range in which the air-fuel ratio is controlled, making it difficult to quickly correct deviations of the air-fuel ratio from the desired ratio. As a consequence, the conversion efficiencies of the three-way catalyst are lowered considerably, particularly with respect to carbon monoxide and nitrogen oxides.

As a solution to this problem, it has been proposed to provide a variable air bleed, which is a combination of a needle valve and a vacuum-operated valve actuator of a diaphragm type. The variable air bleed is provided to the auxiliary air bleed passage such that the effective cross-sectional area of the auxiliary air bleed passage decreases as the magnitude of the venturi vacuum exceeds a certain level and becomes still greater. Such an arrangement maintains the aforementioned air-fuel ratio range practically constant irrespective of the flow rate of air in the intake passage.

However, this variable air bleed is a costly device because it is complicated in construction and has a large number of parts some of which must be produced and assembled with very high precision.

SUMMARY OF THE INVENTION

The invention is concerned with a system for feedback control of the air-fuel ratio of an air-fuel mixture prepared in a carburetor provided to an internal combustion engine. The carburetor has a main fuel passage provided with an air bleed passage. The control system is of the type including an auxiliary air bleed passage communicating with the main fuel passage of the carburetor. An electromagnetic valve in the auxiliary air bleed passage controls the air flow rate through the auxiliary air bleed passage. An exhaust sensor disposed in an exhaust passage of the engine detects the concentration of a specific component of the exhaust gas discharged from the engine as an indication of the measured air-fuel ratio of an air-fuel mixture burned in the engine to produce a feedback signal representative of the detected concentration. A control means produces a control signal based on the feedback signal and supplies a pulse signal to the electromagnetic valve to correct any deviation of the air-fuel ratio represented by the feedback signal from a predetermined air-fuel ratio.

It is a fundamental object of the invention to prevent an undesirable augumentation of the effect of air admission into the main fuel passage through the auxiliary air bleed passage when the engine is operating at high speed and high load where the flow rate of air in the intake passage increases to thereby make it possible to control the air-fuel ratio always within an almost constant range irrespective of the engine speed by providing the air-fuel ratio control system with a novel mechanism, which is quite effective, very simple in construction and low in production cost.

An air-fuel ratio control system according to the invention is of the aforementioned type and, as the essential feature of the invention, includes a vacuum passage which opens into a venturi section of an intake passage of the engine and is connected to the auxiliary air bleed passage at a section upstream of the electromagnetic valve. A vacuum-responsive valve is arranged in the vacuum passage as to block the vacuum passage while the magnitude of the vacuum in the venturi section is below a predetermined level. The valve gradually opens in response to the magnitude of the venturi vacuum when the magnitude of the vacuum is above the predetermined level.

The combination of the vacuum passage and the vacuum-responsive valve automatically lowers the efficiency of air admission through the auxiliary air bleed passage during high-speed operation of the engine and therefore compensates for the aforementioned tendency of the maximal value of the air-fuel ratio under the feedback control increasing when the engine speed exceeds a certain level. As a consequence, the width of a range within which the air-fuel ratio is controlled (hereinafter, this "width" will be referred to as control width of air-fuel ratio) can be maintained nearly constant irrespective of the speed and load of the engine.

As a concrete and preferable example, the vacuum-responsive valve includes a valve seat formed in the vacuum passage, a valve member disposed in the vacuum passage and a spring arranged to bias the valve member toward the valve seat such that the valve member is in contact with the valve seat when the magnitude of the vacuum in the venturi section is below the predetermined level. The valve member gradually moves away from the valve seat against the force of the spring when the magnitude of the vacuum increases beyond the predetermined level. The combination of the vacuum passage and the vacuum-responsive valve in this form is very simple in construction, has a small number of parts and does not require very high precision in the manufacture and assemblage of the parts. Therefore, the cost of this combination is far lower than the aforementioned variable air bleed.

DESCRIPTION OF THE PREFERRED EMBODIMENT

Figure 1:
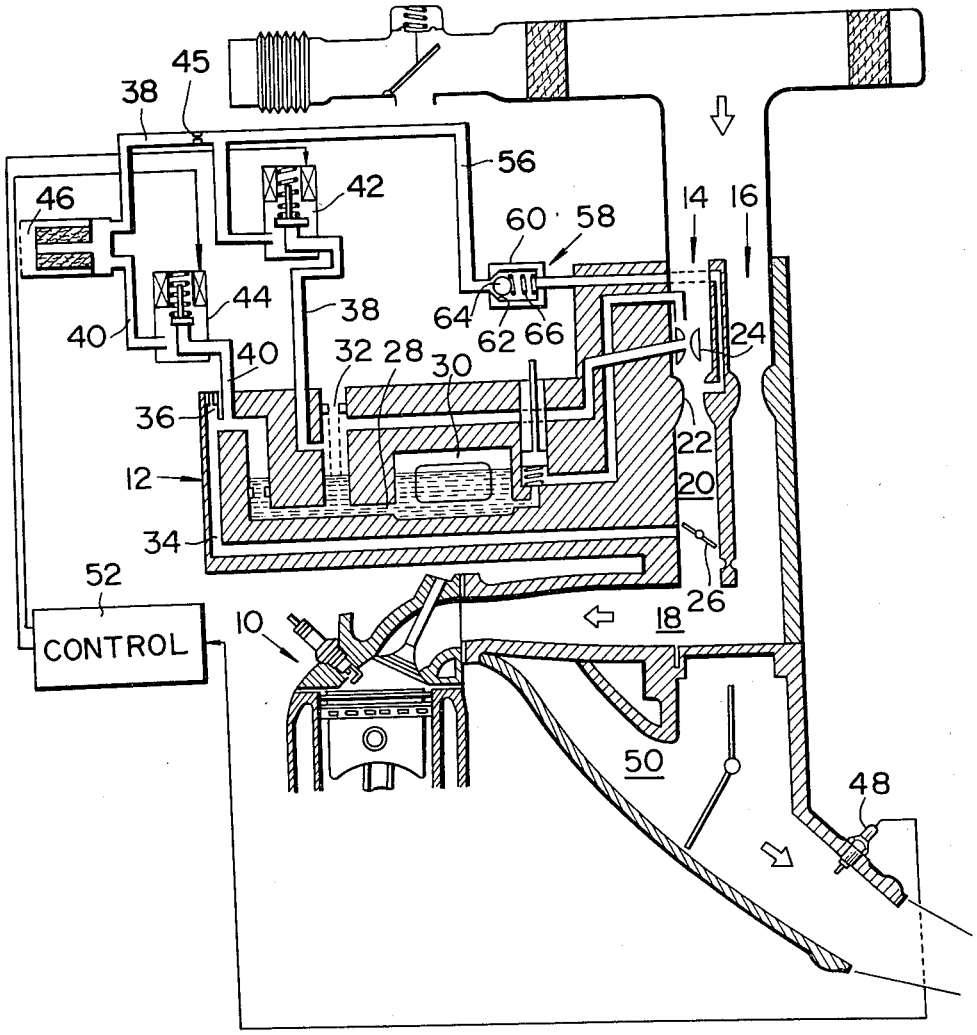
FIG. 1 is a schematic illustration of an air-fuel ratio control system embodying the invention.

In the embodiment of FIG. 1, an air-fuel ratio control system according to the invention is applied to a two-barrel carburetor 12 of an automotive internal combustion engine 10.

A primary section 14 of this carburetor 12 includes a primary intake passage 20, as a part of an intake passage 18 of the engine 10, formed with main and secondary venturis 22 and 24 and provided with a throttle valve 26 at a location downstream of the main venturi 22. A main fuel passage 28 extends from a float chamber 30 to open into the secondary venturi 24. Also provided are a main air bleed 32 for the main fuel passage 28, a slow fuel passage 34 branching off from the main fuel passage 28 to open into the primary intake passage 20 at a location near the throttle valve 26, and a slow air bleed 36 for the slow fuel passage 34. The particulars of a secondary section 16 of the carburetor 12 are omitted from illustration because in this embodiment the air-fuel ratio control system is provided to only the primary section 14.

The air-fuel ratio control system is constructed in the following manner.

An auxiliary air bleed passage 38 is provided to the main air bleed 32, and an electromagnetic valve 42 of the on-off type is disposed so as to control the rate of admission of air into the main fuel passage 28 through the auxiliary air bleed passage 38. A metering orifice 45 is formed in the auxiliary air bleed passage 38 at a location upstream of the electromagnetic valve 42. Similarly, a combination of an auxiliary air bleed passage 40 and an electromagnetic valve 44 of the on-off type is provided to the slow air bleed 36. The two auxiliary air bleed passages 38 and 40 extend from a common air filter 46.

An oxygen sensor 48, as an example of conventional exhaust sensors, is disposed in an exhaust passage 50 of the engine 10 to detect the concentration of oxygen in the exhaust gas as an indication of the air-fuel ratio of an air-fuel mixture burned in the engine 10 and produce an output voltage representative of the detected concentration. An electronic control circuit 52 receives the output voltage of the oxygen sensor 48 as a feedback signal representative of an actual air-fuel ratio and compares it with a reference voltage representative of a desired air-fuel ratio. The control circuit 52 produces a constant frequency control pulse signal (for example, 40 Hz having a variable duty ratio, based on the result of this comparison and feeds this control signal to the solenoids (no numerals) of the electromagnetic valves 42 and 44 to periodically open and close these valves 42 and 44 at the constant frequency. The duty cycle ratio of the pulse signals varies such that the proportion of the open-time of the electromagnetic valves 42 and 44 to the closed-time increases when the measured air-fuel ratio indicated by the output voltage of the oxygen sensor 48 is lower than the desired ratio, and vice versa.

As the improvement according to the invention, the control system includes a combination of a vacuum passage 56 and a vacuum-responsive valve 58. The vacuum passage 56 branches off from the auxiliary air bleed passage 38 at a location between the metering orifice 45 and the electromagnetic valve 42 and opens into the main venturi 22. The vacuum-responsive valve 58 has a ball valve member 64 disposed in a housing 60 which occupies a section of the vacuum passage 56. A spring 66 is arranged in the housing 60 so as to bias the ball valve member 64 toward housing 60 valve seat 62, against a suction force by the vacuum in the main venturi 22.

The force of the spring 66 is determined such that the ball valve member 64 remains in tight contact with the valve seat 62 while the magnitude of vacuum in the main venturi 22 is below a predetermined level. Ball valve 64 gradually moves away from the valve seat 62 when the magnitude of the vacuum increases beyond the predetermined level.

The air-fuel ratio control system thus constructed operates in the following manner.

When the control circuit 52 determines from the output voltage of the oxygen sensor 48 that the measured air-fuel ratio is higher than the desired ratio, the control circuit 52 varies the duty ratio of the control pulse signal to reduce the proportion of the open-time of the electromagnetic valves 42 and 44 to the closed-time. As a consequence, there is a reduction in the amount of air admitted into the main and slow fuel passages 28 and 34 through the auxiliary air bleed passages 38 and 40 and therefore the controlled air-fuel ratio lowers. On the contrary, when the control circuit 52 determines that the measured air-fuel ratio is lower than the desired ratio, the control circuit 52 varies the duty ratio of the control pulse signal in the reverse way to increase the amount of air introduced into the fuel through the auxiliary air bleed passages 38 and 40. Therefore the controlled air-fuel ratio rises.

Fluctuations of the air-fuel ratio from the desired ratio are corrected in this manner. However, it is impossible to maintain the air-fuel ratio exactly at the desired ratio, because there is an inevitable time delay in the action of each component of the control system, and the flow of fuel, the air-fuel mixture and the exhaust gas in a fluid passage extending from the carburetor 12 to the position of the oxygen sensor 48 in the exhaust system takes a considerable time. Accordingly, the control circuit 52 repeatedly increases and decreases the duty ratio of the control pulse signal so that the electromagnetic valves 42 and 44 repeatedly open and close. Accordingly the air-fuel ratio repeatedly rises and falls across the desired ratio in a certain range, the width of which is herein called control width. The highest and lowest boundaries of this range can be regarded as air-fuel ratios produced when the electromagnetic valves 42 and 44 are continuously kept open and closed, respectively.

Figure 3:
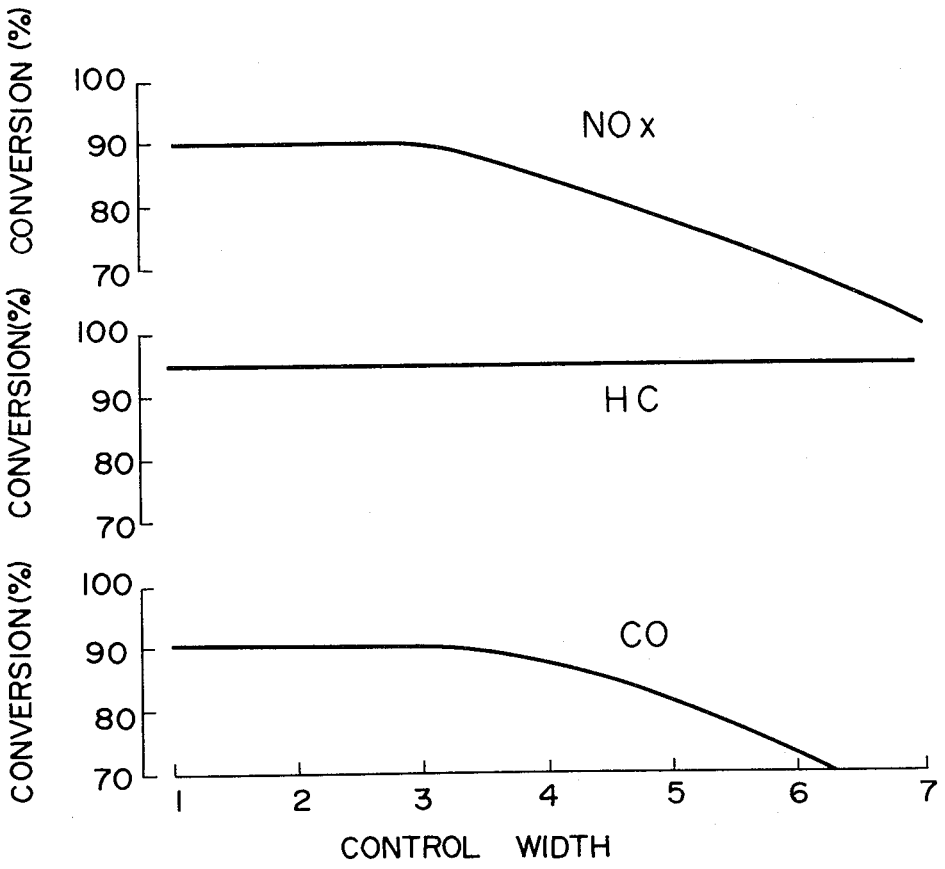
FIG. 3 is a graph of the relation between the control width of air-fuel ratio and the conversion efficiencies of a three-way catalyst in the exhaust gas.

Of course, it is undesirable for the control width of the air-fuel ratio to be too broad. For instance, when the three-way catalyst is employed to purify the exhaust gas, the conversion efficiency of this catalyst varies with the middle or average value of the air-fuel ratio and the scale of the control width. FIG. 3 includes graphs of an example of the results of experiments about this matter. It is recognized from FIG. 3 that even when the air-fuel ratio is controlled with the aim of a stoichiometric ratio, the conversion efficiencies with respect to CO and $NO_x$ decrease when the control width is larger than about 3 (in terms of air-fuel ratio by weight). Accordingly, it is desirable for the control width to be narrower than about 3.

Figure 4:
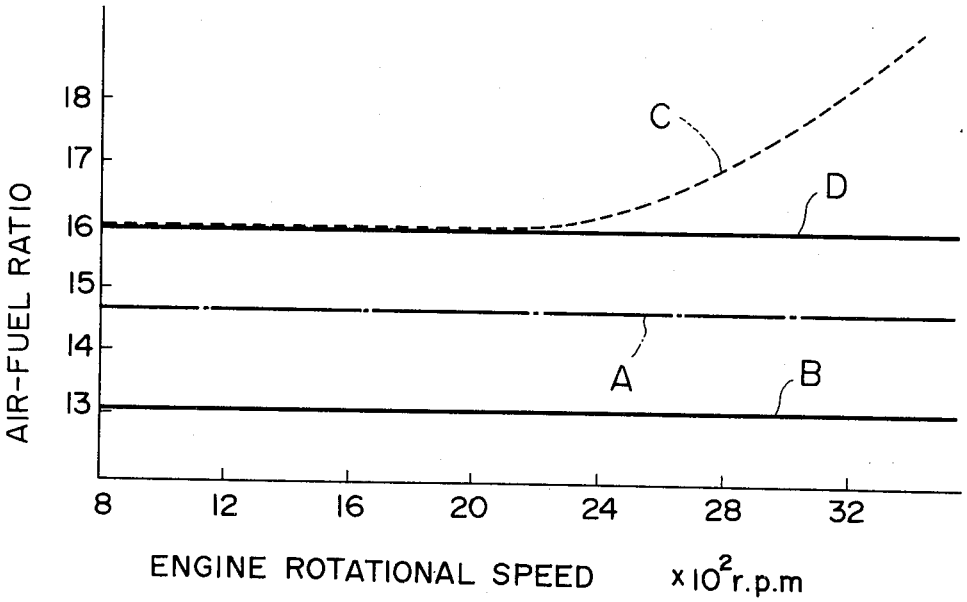
FIG. 4 is a graph of the relation between the engine rotational speed and the maximum and minimum values of air-fuel ratio under feedback control.

In an air-fuel ratio control system of the general type described in the present application, the control width and the highest and lowest values of the air-fuel ratio are expected to be almost independent of the engine speed. Actually, however, when the system of FIG. 1 is not provided with the vacuum passage 56 and the vacuum-responsive valve 58 (then, this system becomes an example of a known system), a change, illustrated in FIG. 4, occurs in the highest value of air-fuel ratio during high speed and high load operation of the engine, as mentioned hereinbefore. In FIG. 4, line A represents the desired air-fuel ratio which is, for example, the stoichiometric air-fuel ratio. Line B represents the lowest value of the air-fuel ratio under control of the aforementioned known or supposed control system, and the line C represents the highest value of the air-fuel ratio. As can be seen, the lowest value of the air-fuel ratio does not vary with the engine rotational speed, but the highest value becomes greater as the engine rotational speed exceeds a certain level (for example, 2,200 r.p.m.) and increases further. That is, in the high speed range, the effect of air admitted through the auxiliary air bleed passage 38 becomes unduly great, although the action of the electromagnetic valve 42 does not vary. Accordingly, the control width becomes considerably large during high speed operation, so that it becomes impossible to maintain control width at about 3 in the high speed range although the control system is capable of maintaining the control width at about 3 in the low and medium speed ranges.

The combination of the vacuum passage 56 and the vacuum-responsive valve 58 according to the invention prevents such an unfavorable phenomenon; it functions in the following manner.

Figure 2A:
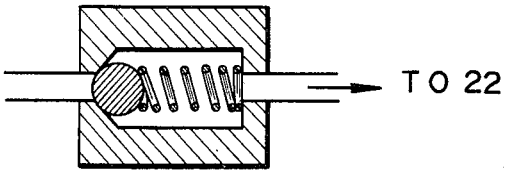
FIGS. 2(A), 2(B) and 2(C) are schematic diagrams of a preferred example of a vacuum-responsive valve in a system of the invention in fully closed, partly open and fully open states, respectively.

When the magnitude of the vacuum in the main venturi 22 is below a predetermined level during low speed and low load operation of the engine 10, the ball valve member 64 is in tight contact with the valve seat 62 by the action of the force of the spring 66, so that the vacuum-responsive valve 58 completely blocks the vacuum passage 56, as shown in FIG. 2(A). Accordingly, the venturi vacuum is not transmitted to the auxiliary air bleed passage 38, and therefore, during opening of the electromagnetic valve 42 the auxiliary air bleed passage 38 admits air at the atmospheric pressure into the main fuel passage 28. That is, the combination of the vacuum passage 56 and the vacuum-responsive valve 58 does not affect the control of the rate of feed of air through the auxiliary air bleed passage 38 in the low speed range (for example, below 1,200 r.p.m.) of the engine 10.

Figure 2B:
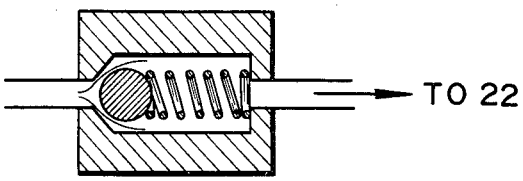

When the magnitude of the venturi vacuum exceeds the aforementioned predetermined level during medium speed and medium load operation of the engine 10, the ball 64 begins to move to the right in the drawing against the force of the spring 66, so that the valve 58 opens the vacuum passage 56 slightly, as shown in FIG. 2(B). Accordingly, a small portion of air admitted into the auxiliary air bleed passage 38 flows through the vacuum passage 56 into the primary intake passage 20. In other words, air somewhat diluted by the venturi vacuum is admitted into the main fuel passage 28 through the auxiliary air bleed passage 38. Such dilution of air compensates for an increasing tendency of the effect of the auxiliary air bleed passage 38 as a phenomenon accompanying a rise in the engine speed. As a consequence, the highest value of the controlled air-fuel ratio remains unchanged even when the engine speed increases in the medium speed range (for example, between 1,200 and 2,200 r.p.m.), as represented by the line D in FIG. 4. However, the valve 58 is adjusted such that in this engine speed range air admitted into the auxiliary air bleed passage 38 is only slightly diluted with the venturi vacuum because in this engine speed range the augmenting tendency of the effect of the auxiliary air bleed passage 38 is almost negligible.

Figure 2C:
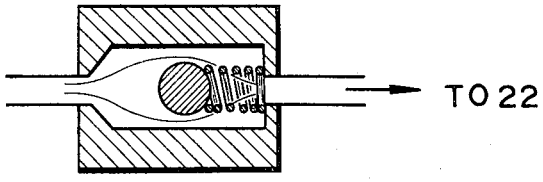

When the engine 10 operates at high speed and high load so the venturi vacuum is very strong, the ball 64 moves further to the right so that the valve 58 fully opens the vacuum passage 56 as shown in FIG. 2(C). As a result, air admitted through the auxiliary air bleed passage 38 into the main fuel passage 28 is considerably diluted with the venturi vacuum. Accordingly, it is possible to compensate for the great tendency of the augmented air to be admitted through the auxiliary air bleed passage 38 during high-speed and high-load operation of the engine 10. Consequentially, the highest value of the air-fuel ratio and, hence, the control width of the air-fuel ratio remain almost constant even in this high speed range (for example, above 2,200 r.p.m.), as represented by the line D in FIG. 4.

When the opening degree of the throttle valve 26 is greater than a predetermined value, for instance, 63 degrees, the operation of the air-fuel ratio control system of FIG. 1 is stopped in order to maintain a relatively low air-fuel ratio necessary for producing high power.

Figure 5:
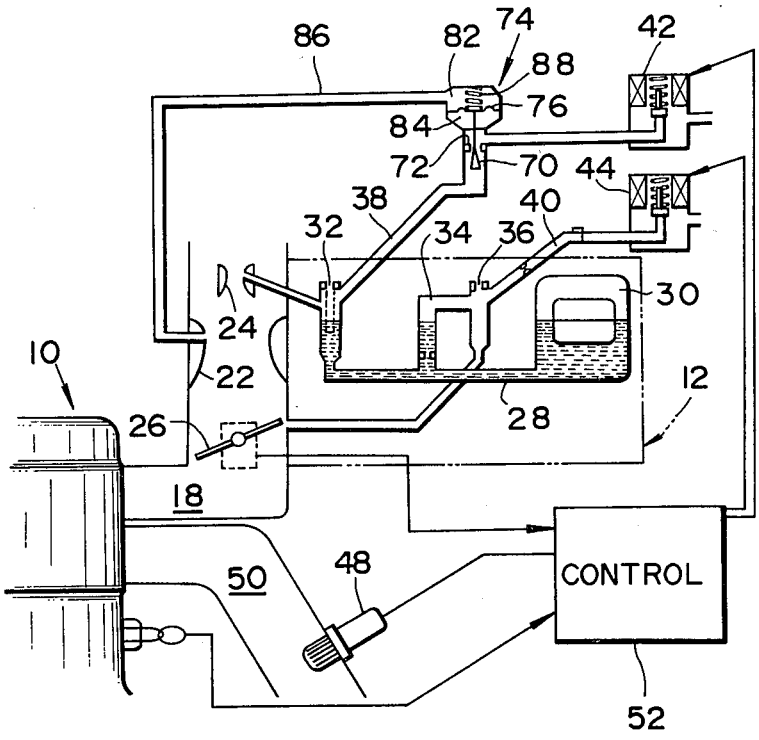
FIG. 5 Prior Art
FIG. 5 is a diagrammatic illustration of a prior art air-fuel ratio control system.

For the sake of comparison, FIG. 5 is a schematic illustration of an air-fuel ratio control system that employs a variable air bleed mentioned in "BACKGROUND OF THE INVENTION" in this specification.

The air-fuel ratio control system of FIG. 5 is quite similar to the system of FIG. 1 but differs in that the vacuum passage 56 and the vacuum-responsive valve 58 in FIG. 1 are replaced by a combination of a needle valve 70 disposed in a metering jet 72 formed in the auxiliary air bleed passage 38, and a vacuum-operated device 74 for moving the needle valve 70. The vacuum-operated device 74 has a flexible diaphragm 76 which supports the needle valve 70 and serves as a partition between a vacuum chamber 82 and an atmospheric pressure chamber 84. A vacuum passage 86 connects the vacuum chamber 82 to the main venturi 22 in the intake passage 18.

The needle valve 70 is positioned to fully open the auxiliary air bleed passage 38 when the vacuum in the main venturi 22 is weak during low speed operation of the engine 10. However, when the speed of the engine 10 exceeds a predetermined value, 2,200 r.p.m., for example, and increases further, the diaphragm 76 in the device 74 begins to move against the action of a spring 88 such that the needle valve 70 gradually narrows the effective cross sectional area of the metering jet 72 in dependence on the magnitude of the venturi vacuum. The decrease in the effective cross-sectional area of the auxiliary air bleed passage 38 suppresses the undesirable tendency of additional air being admitted through the auxiliary air bleed passage 38 into the main fuel passage 28. As a result, the maximum value of the controlled air-fuel ratio remains practically constant even at high engine speeds above 2,200 r.p.m. for instance.

Thus, the combination of the needle valve 70 and the valve actuator 74 of FIG. 5 is similar in effect to the combination of the vacuum passage 56 and the vacuum-responsive valve 58 of FIG. 1, but the former is far more costly for the reasons described hereinbefore.

What is claimed is:

1. In a system for feedback control of the air-fuel ratio of an air-fuel mixture fed to an internal combustion engine, a carburetor having a main fuel passage provided with an air bleed passage;

said control system including an auxiliary air bleed passage communicating with said main fuel passage;

an electromagnetic valve disposed in said auxiliary air bleed passage so as to control the air flow rate through said auxiliary air bleed passage;

an exhaust sensor disposed in an exhaust passage of the engine for detecting the concentration of a specific component of the exhaust gas discharged from the engine as an indication of the air-fuel ratio of an air-fuel mixture burned in the engine and deriving a feedback signal representative of the detected concentration;

control means for producing a control signal based on said feedback signal and supplying said control signal to said electromagnetic valve to correct any deviation of the air-fuel ratio represented by said feedback signal from a predetermined air-fuel ratio;

a vacuum passage opening into a venturi section of an intake passage of the engine and connected to said auxiliary air bleed passage; and a vacuum-responsive flow restriction valve so arranged in said vacuum passage as to (a) block said vacuum passage while the magnitude of vacuum in said venturi section is below a predetermined level and (b) gradually open in dependence on the magnitude of said vacuum when the magnitude of said vacuum rises above said predetermined level.

2. A system according to claim 1, further including a metering orifice disposed in said auxiliary air bleed passage at a section upstream of a junction of said auxiliary air bleed passage and said vacuum passage.

3. A system according to claim 1 or 2, wherein said vacuum-responsive flow restriction valve comprises a valve seat formed in said vacuum passage, a valve member movably disposed in said vacuum passage, and a spring so arranged as to bias said valve member toward said valve seat such that said valve member is in contact with said valve seat while the magnitude of said vacuum is below said predetermined level but gradually moves away from said valve seat against the force of said spring in response to the increase in the magnitude of said vacuum above said predetermined level.

4. A system according to claim 3, wherein said valve member is a ball member.

5. A system according to claim 3, wherein said vacuum-responsive flow restriction valve is constructed to be fully open when the magnitude of said vacuum reaches a second predetermined level higher than the first said predetermined level.

6. A system according to claim 1 or 2, wherein said electromagnetic valve is of the on-off function type and said control signal is a pulse signal of a constant frequency and variable duty ratio.

7. A system according to claim 6, wherein said carburetor has a slow fuel passage including an air bleed passage, said control system further comprising another auxiliary air bleed passage which communicates with said slow fuel passage and is independent of said auxiliary air bleed passage, another electromagnetic valve of the on-off type in said another auxiliary air bleed passage so as to periodically open and close said another auxiliary air bleed passage, said control means also supplying said control pulse signal to said another electromagnetic valve.

* * * * *